United States Patent [19]

Keil

[11] Patent Number: 4,999,017

[45] Date of Patent: Mar. 12, 1991

[54] MULTI-COLOR WRITING UTENSIL

[75] Inventor: Georg Keil, Gross-Bieberau, Fed. Rep. of Germany

[73] Assignee: Firma Merz & Krell GmbH & Co., Gross-Bierberau, Fed. Rep. of Germany

[21] Appl. No.: 480,480

[22] Filed: Feb. 15, 1990

[30] Foreign Application Priority Data

Feb. 24, 1989 [DE] Fed. Rep. of Germany ..... 3905858

[51] Int. Cl.[5] ..... B43K 27/04; B43K 21/16

[52] U.S. Cl. ..... 401/32; 401/33

[58] Field of Search ..... 401/32, 33, 29, 17, 401/16

[56] References Cited

U.S. PATENT DOCUMENTS

| | | | |
|---|---|---|---|
| 2,476,866 | 7/1949 | Heyman | 401/32 |
| 2,480,014 | 8/1949 | Germann | 401/29 |
| 2,737,155 | 3/1956 | Berney | 401/32 |
| 4,202,641 | 5/1980 | Tomura | 401/32 |

FOREIGN PATENT DOCUMENTS

| | | |
|---|---|---|
| 1933520 | 2/1966 | Fed. Rep. of Germany . |
| 1461617 | 1/1970 | Fed. Rep. of Germany . |

*Primary Examiner*—Richard J. Johnson
*Attorney, Agent, or Firm*—Herbert Dubno

[57] ABSTRACT

A writing utensil for three different leads is provided in which due to the use of a special front part and a pusher housing being easily insertable into the same, a conventional writing utensil with only one lead can be converted in a simple and robust fashion to a three-color writing utensil. The pusher housing loosely inserted into the shaft housing, which supports the leads, has a profiled contour and can tilt freely into one of several predetermined tilting positions under the effect of gravity and as a function of the rotary position of the shaft housing in order to bring a selected lead into a ready position from which it can be displaced into the writing position.

9 Claims, 2 Drawing Sheets

Fig. 1
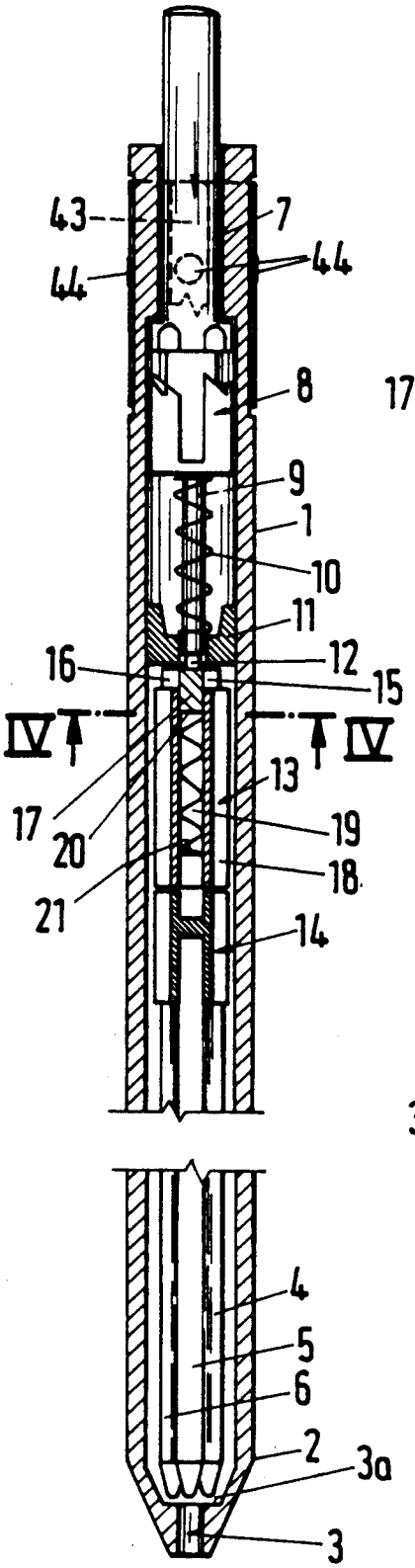
Fig. 2
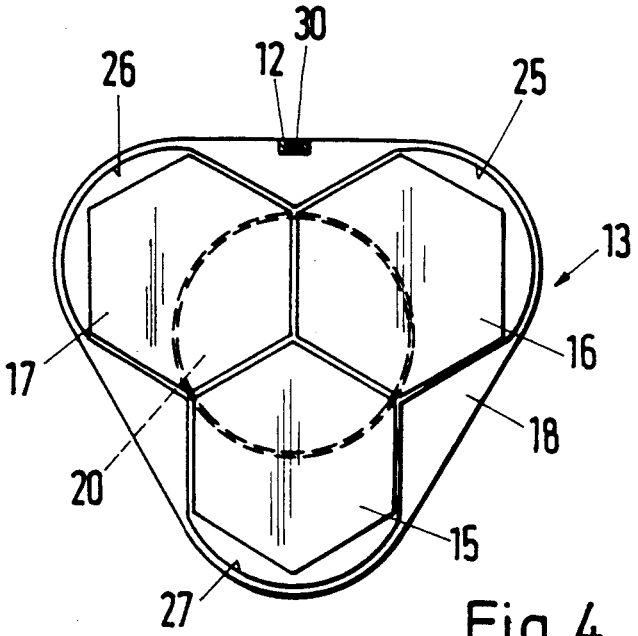
Fig. 4
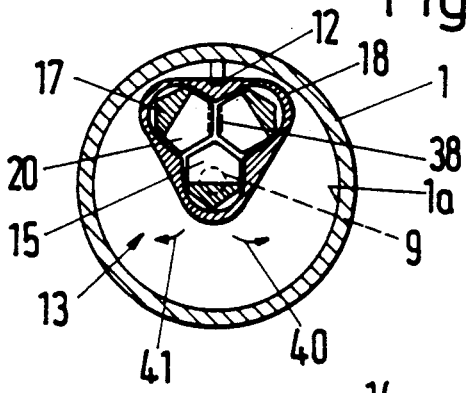
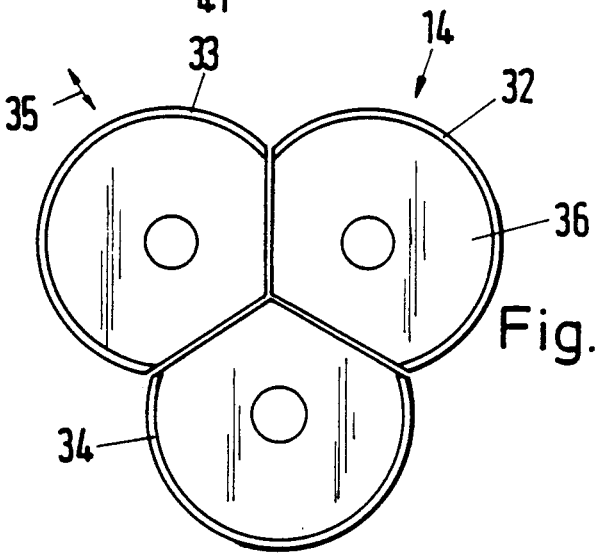
Fig. 3

MULTI-COLOR WRITING UTENSIL

BACKGROUND OF THE INVENTION

1. Field of the Invention

The invention relates to a writing utensil.

2. The Related Art

Writing utensils are known which have several leads of a different type or a different colour, which can be optionally brought into the writing position. For instance, a pendulum means, may be disposed in area of the press mechanism, which couples a press mechanism with a selected lead under the effect of gravity and a position of the shaft housing so that upon the acutation of the press mechanism the respective lead is advanced. In other embodiments, driving cams are disposed on the press mechanism which can engage at longitudinally displaceable supporting means of the leads via driving lugs in order to advance a selected lead into the writing position as a function of a rotational movement of the press mechanism. The latter arrangement can mostly only be used in writing utensils with two leads. The means suited for more than two leads are relatively expensive, susceptible to failures and expensive as regards production and assembly.

It is the object of the invention to further develop a writing utensil having the features of the preamble in such fashion that a reliable function is ensured with a simple, low-cost design.

SUMMARY OF THE INVENTION

A writing utensil is provided which comprises:

a shaft housing having an inner surface;

a plurality of leads within the housing, each of the leads being individually advanceable and restorable from one to another position within the housing;

a front outlet at one end of the housing through which a tip of one of the leads may protrude;

a pressure mechanism with a press element, the press element being partially outside of the shaft housing;

a press rod through which the leads can be shifted into a writing position, the press rod being located between the press element and the front outlet;

a restoring spring surrounding the press rod;

a shift rotor biased by the restoring spring;

a selector control means for bringing the press rod and one of the leads into a predetermined position, the selector control means comprising:

a plurality of receivers for holding the leads, the receivers being displaceable in a longitudinal direction;

a pusher housing loosely inserted into the shaft housing, the pusher housing having a cross-sectional size and contour shape dimensioned with respect to the inner surface permitting the pusher housing to adopt a plurality of positions defined as a function of gravity and of a rotary position of the shaft housing, each of the positions having one of the leads signed thereto, being mounted elastically displaceable in the pusher housing, and being movable into alignment with the press rod; and a plurality of rear head portions each assigned and connected to a respective receiver, the rear head portions being mounted non-rotatably in a section of the pusher housing.

The selector control means can be easily premounted and inserted into the shaft housing. The selector control means can be used in almost all known writing utensil designs without substantially modifying the main elements of the writing utensil. It is of no importance in which fashion the press rod for advancing a lead can be caused to move longitudinally. The longitudinal movement of the press rod can also be caused by a screw element replacing the press element with corresponding movement translation means. A relatively short stroke is also only necessary for actuating the selector control means, which, in turn, favours the mani-sided usability of the selector control means in different writing utensils.

The selector control means can be produced completely without expensive metal parts. The arrangement is robust, since the pusher housing is of a compact design and can be loosely inserted into the shaft housing. The pusher housing serves at the same time to receive and guide the leads.

The new writing utensil is especially suited for three leads of different type, in particular of different colours. For this purpose, the pusher housing will have a contour shape in the form of an equilateral triangle with rounded corners. For each of the three sections of the triangle, a lead is held and displaceably guided approximately in alignment with the rounded corners in the pusher housing. The cross-sectional dimensions of the pusher housing are selected in such fashion that each time two of its rounded corners rest against an inner surface of the shaft housing, the lead allocated to the third corner is in each case approximately centrally positioned in the shaft housing cross-section. The pusher housing in the shaft housing can tilt about the one or the other rounded edge of the triangle under the effect of gravity and as a function of the rotary position of the shaft housing so that two other rounded edges come to rest against the inner surface of the shaft housing and the third edge of the triangle is located in the centre of the shaft housing. The pusher housing thus forms a loose tilting body mounted with considerably clearance in the shaft housing. Three stable positions are available in which in each case one of the three leads is aligned in a central position of the shaft housing in alignment with the press rod.

In order to restrict the movement possibilities of the freely inserted pusher housing in the shaft housing to the three selected stable positions, a movement limiting means may be provided. The movement limiting means limits the possible, relative rotary positions of the pusher housing as a function of the rotary direction of the shaft housing in predetermined fashion. This means can be of various design. A control recess with a profiled contour deviating from the inner contour of the shaft housing may be provided in a transverse wall of the shaft housing, into which projects the end of the pusher housing with triangular cross-section. The contour profile of the recess may be coordinated with the triangle cross-section of the pusher housing in such fashion that the pusher housing can only carry out specific and limited tilting movements in the recess as a function of gravity, which correspond to the aforementioned three tilting movements.

One design, in particular, of the movement limiting means is especially simple for production and assembly. This design has the limiting means comprising a movement control cam and a control element engaging in the same catch on the pusher housing and a fixed transverse wall of the shaft housing. A radial groove in the transverse wall may serve as the control cam and a pin projecting beyond the end of the pusher housing serves as the control element, the latter being disposed approximately in alignment with a side of the triangle centrally between two rounded corners of the pusher housing.

The pusher housing is secured in axial direction in the shaft housing. A restoring spring jointly allocated to the leads is disposed centrally in the pusher housing, which is supported on pusher shoulders towards the press element end and on a shoulder of the pusher housing towards the writing end. The design permits the use of a single restoring spring for all three leads which is built into the pusher housing. Leads are inserted between a guide insert for the press rod and a stop shoulder cooperating with the ends of the leads in the front end of the shaft housing. The two respectively unused leads secure the axial position of the pusher housing in the shaft housing even if the third lead is in the writing position.

The invention makes it possible to remodel a conventional writing utensil into a three-colour writing utensil only by the use of an especially designed front part and by the use of the pusher housing as an adapter kit, a single-spring suspension of the leads being avoided.

BRIEF DESCRIPTION OF THE DRAWING

The invention is explained in more detail through the following schematic drawings of an illustrative embodiment wherein:

FIG. 1 shows a longitudinal section through the new writing utensil according to the invention;

FIG. 2 shows an expanded scale view to the rear front side of the pusher housing used in the writing utentil according to FIG. 1.

FIG. 3 shows in a representation similar to FIG. 2 a front view of the opposite front side of the pusher housing FIG. 4 shows a horizontal section through the writing utensil according to FIG. 1 along the sectional line IV—IV.

DETAILED DESCRIPTION

Figure 6:
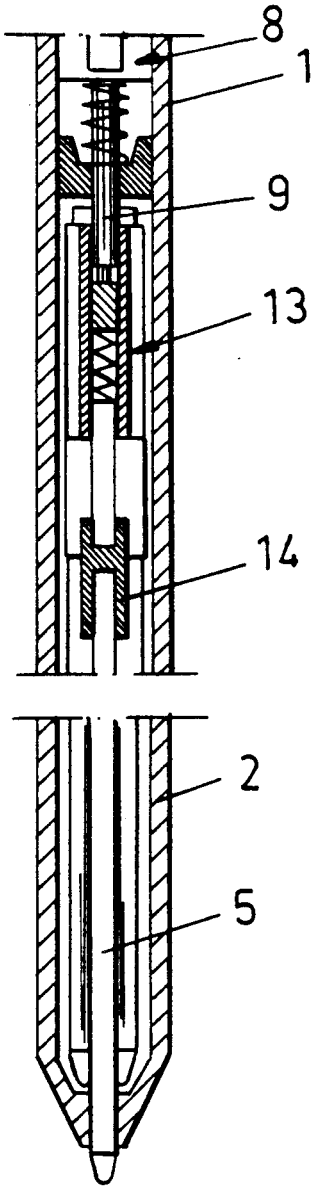
FIG. 6 shows the writing utensil with one of the leads in the extended position.
Figure 5:
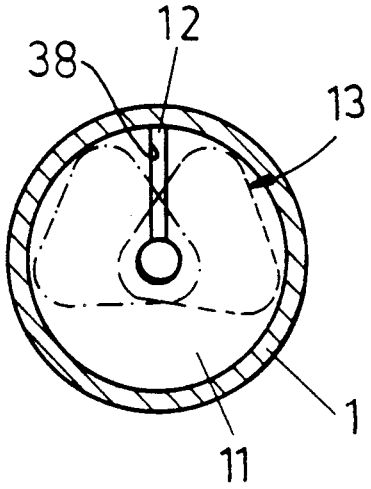
FIG. 5 shows a view similar to FIG. 4 but illustrates two possible positions of the pusher housing.

The writing utensil according to FIG. 1 has a hollow cylindrical shaft housing 1, which may also be designed in multipiece fashion seen in the longitudinal direction.

The shaft housing 1 has a guide opening 3 at its front end 2 for the front end or the writing tip of a lead 4, 5, 6. The writing utensil according to FIG. 1 is provided for three leads of a different type, in particular of a different colour in the represented preferred embodiment.

The writing utensil has an actuating mechanism at its rear end. This may be one of the known mechanisms such as a rotary mechanism or a press mechanism. In the respresented example, a press mechanism with a press element 7 projecting beyond the end is provided which acts displacingly on a press rod 9 via a known rotor which is biased by means of a restoring spring 10 supported on a fixed insert 8 in the direction towards the position withdrawn towards the press end. The front end of the press rod is guided longitudinally movably in a bore of the transverse wall or of a recess 11.

A pusher housing 13 is inserted freely and loosely in the shaft housing 1 before the transverse wall 11. As is revealed by FIG. 4 the transverse dimensions of the pusher housing 13 are small with respect to the inner cross-section of the shaft housing 1. The pusher housing forms a selector control means wherein the lead can be selected which is to be brought into the writing position by means of the press mechanism. The selection is effected under the effect of gravity and as a function of the rotary position of the shaft housing 1.

In the preferred embodiment example with three different leads the pusher housing 13 has a contour in the shape of an equilateral triangle with corners rounded across a large radius of curvature. A support 14 for the leads is provided, which faces the writing end 2 of the writing utensil. It consists of a bundle of three receivers 32, 33, 34, which can be displaced independently from each other in longitudinal direction and which have a limited recess 36 at their front end, into which the rear end of the leads 4 to 6 can be pushed in with press fit. The receivers can be easily deformed elastically as outlined by the arrow 35 and thus hold the lead fast.

Each receiver 32 to 34 is firmly connected to a rear head portion 15 or 16 or 17 and forms with it a pusher being rigid in longitudinal direction, which is mounted and guided non-rotatably, but displaceably in longitudinal direction in a housing section 18 of the pusher housing 13. Each pusher may be designed in two-piece fashion, the two pieces being firmly connected with each other during assembly so that the movement of each pusher is limited towards the rear end due to a striking of the support 32 against 34 at the lower end of the housing section 18, while, on the other hand, the movement of the pusher towards the front is also limited to a predetermined stroke length.

The housing section 18 has an inner blade-shaped profile, each of the blade sections 25, 26, 27 serving for receiving and guiding one of the pushers 15 to 17. The heads of the pushers are undercut towards the centre as it is represented in dashed fashion in FIG. 2 and at 20 in FIG. 4 in unbroken lines so that a central joint receiver is formed for a joint lead restoring spring 19.

It can be recognized in FIG. 4 that the contour profile of the pusher housing 13 is designed in such fashion with respect to the inner surface 1*a* of the shaft housing 1 that the pusher housing can tilt in the shaft under the effect of gravity and as a function of the rotary position of the shaft housing 1 (based on the axis of the shaft housing) into three selected stable positions. Like the position shown in FIG. 4 each position is determined by the fact that two rounded corners of the pusher housing rest against the inner surface 1*a* of the shaft housing. The central position of the pusher housing is represented in FIG. 4, it being assumed that the lead pusher 15 being in alignment with the press rod 9 is forwardly advanced by the press rod through the front opening 3 of the writing utensil so that thereby the position of the pusher housing 13 is fixed independently of the rotary position of the writing utensil in the shown position. If, on the other hand, the press rod 9 is withdrawn and releases the pusher housing, it can tilt into another one of the two stable positions about the rounded corners of its cross-section.

To limit these tilting movements to the three indicated positions a limiting means is provided. In the preferred represented embodiment example a radial groove 38 is provided for this in the forwardly pointing front surface of the transverse wall or of the insert 11, into which a pin 12 projects with inserted pusher housing 13, which is firmly anchored with its shaft end 30 in a side wall centrally between two rounded corners of the section 18 of the pusher housing. Due to this a slipping of the pusher housing in circumferential direction is excluded and it is ensured that the pusher housing can only tilt from the position shown in FIG. 4 into the one or the other side into the second or third stable position in accordance with the arrows 40 and 41. It is furthermore evident that in these tilting movements either the pusher 16 or the pusher 17 gets into the position of the pusher 14 in FIG. 4 depending upon the tilting direction and thus in alignment with the press rod 9 so that another lead can be advanced into the writing position.

The different leads can be recognized at the outside of the shaft housing 1 by means of colour markings, it being possible that one of the markings is provided e.g. on the clip 43 outlined in FIG. 1. In this case the central position shown in FIG. 4 is indicated on the clip, the radial groove 38 extending from the centre in the direction towards the clip.

I claim:

1. A writing utensil comprising:

a shaft housing having an inner surface;

a plurality of leads within said housing, each of said leads being individually advanceable and restorable from one to another position within said housing;

a front outlet at one end of said housing through which a tip of one of said leads may protrude;

a pressure mechanism with a press element, said press element being partially outside of said shaft housing;

a press rod through which said leads can be shifted into a writing position, said press rod being located between said press element and said front outlet;

a restoring spring surrounding said press rod;

a shift rotor biased by said restoring spring;

a selector control means for bringing said press rod and one of said leads into a predetermined position, said selector control means comprising:

a plurality of receivers for holding said leads, said receivers being displaceable in a longitudinal direction;

a pusher housing loosely inserted into said shaft housing, said pusher housing having a cross-sectional size and contour shape dimensioned with respect to said inner surface permitting said pusher housing to adopt a plurality of positions defined as a function of gravity and of a rotary position of said shaft housing, each of said positions having one of said leads assigned thereto, being mounted elastically displaceable in said pusher housing, and being movable into alignment with said press rod; and a plurality of rear head portions each assigned and connected to a respective receiver, said rear head portions being mounted non-rotatably in a section of said pusher housing.

2. A writing utensil according to claim 1, wherein said contour shape of said pusher housing is an equilateral triangle with rounded corners and a lead held in each of three of said rounded corners and displaceably guided approximately in alignment with the rounded corners in the pusher housing.

3. A writing utensil according to claim 1, wherein said cross-sectional dimensions of said pusher housing are selected in such manner that each time two of said rounded corners rests against said inner surface of said shaft housing, said lead allocated to a third of said corners is in each case approximately centrally positioned in said shaft housing cross-section.

4. A writing utensil according to claim 1, wherein said restoring spring is disposed centrally in said pusher housing, said restoring spring being supported on pusher shoulders towards an end of said press element and on a shoulder of said pusher housing towards said front outlet.

5. A writing utensil according to claim 1, wherein said pusher housing is axially secured in an assembled condition of said writing utensil and with inserted leads between a guide insert for said press rod and a stop shoulder cooperating with ends of said leads in a front end of said shaft housing.

6. A writing utensil according to claim 1, wherein said movement limiting means is provided to limit the possible, relative rotary positions of said pusher housing as a function of a rotary direction of said shaft housing in predetermined fashion.

7. A writing utensil according to claim 6, wherein said limiting means comprises a movement control cam and a control element engaging in a same notch on said pusher housing and a fixed transverse wall of said shaft housing.

8. A writing utensil according to claim 7, wherein a radial groove in said transverse wall serves as control cam and a pin projecting beyond said end of said pusher housing serves as control element, which is disposed approximately in alignment with a side of said triangle centrally between two rounded corners of said pusher housing.

9. A writing utensil according to claim 8, wherein said radial groove is oriented towards a clip disposed on said shaft housing.

* * * * *